US006361163B1

(12) United States Patent
Fowlkes

(10) Patent No.: US 6,361,163 B1
(45) Date of Patent: Mar. 26, 2002

(54) INKJET PRINTER, AND METHOD OF ASSEMBLING THE PRINTER, FOR PRINTING AN IMAGE ON A FIRST RECEIVER AND ON A SECOND RECEIVER

(75) Inventor: William Y. Fowlkes, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/358,085

(22) Filed: Jul. 21, 1999

(51) Int. Cl.[7] ..... B41J 2/01

(52) U.S. Cl. ..... 347/104; 400/605; 400/607; 400/612; 271/9.01; 271/9.02; 101/93.11

(58) Field of Search ..... 347/104; 400/605, 400/607, 611, 612; 101/93.11; 271/9.01, 9.02

(56) References Cited

U.S. PATENT DOCUMENTS

| | | | | |
|---|---|---|---|---|
| 4,709,247 | A | 11/1987 | Piatt et al. | 346/140 |
| 4,890,122 | A | 12/1989 | Nileson | 346/140 |
| 5,312,196 | A | 5/1994 | Hock et al. | 400/624 |
| 5,320,436 | A | 6/1994 | Hock et al. | 400/283 |
| 5,326,090 | A | 7/1994 | Hock et al. | 271/162 |
| 5,348,407 | A | 9/1994 | Hock et al. | 400/711 |
| 5,600,351 | A | 2/1997 | Holstun et al. | 347/40 |
| 5,668,581 | A | 9/1997 | Tsuji et al. | 347/37 |
| 5,870,117 | A | 2/1999 | Moore | 347/37 |
| 5,880,757 | A | 3/1999 | Ta | 347/40 |
| 5,883,644 | A | 3/1999 | Nicoloff, Jr. et al. | 347/12 |

FOREIGN PATENT DOCUMENTS

| | | | |
|---|---|---|---|
| EP | 0 288 089 | A2 | 10/1988 |
| EP | 0 841 180 | A2 | 5/1990 |
| EP | 0 914 960 | A2 | 5/1999 |
| JP | 4 197762 | A * | 7/1992 |

* cited by examiner

*Primary Examiner*—John S. Hilten
*Assistant Examiner*—Minh H. Chau
(74) *Attorney, Agent, or Firm*—Norman Rushefsky

(57) ABSTRACT

An inkjet printer, and method of assembling the printer, for printing an image on a first receiver of a first size and on a second receiver of a second size. According to a preferred embodiment of the invention, the first receiver is fed in a first direction and the second receiver is fed in a second direction orthogonal to the first direction. The printer includes an ink jet print head movable in the first direction to print the image on the first receiver in one printing pass and movable to-and-fro in the first direction for printing the image on the second receiver in at least one printing swath. Thus, printing on differently sized receivers is obtained without reorienting the receivers or changing-out the print head to a different size print head.

20 Claims, 7 Drawing Sheets

INKJET PRINTER, AND METHOD OF ASSEMBLING THE PRINTER, FOR PRINTING AN IMAGE ON A FIRST RECEIVER AND ON A SECOND RECEIVER

BACKGROUND OF THE INVENTION

This invention generally relates to printer apparatus and methods for printing images on different sized media and more particularly relates to an inkjet printer and method of assembling the printer, for printing an image on a first receiver of a first size and on a second receiver of a second size, wherein a print head belonging to the printer prints the image on the first receiver and on the second receiver without reorienting the receivers or changing-out the print head to a different size print head.

An ink jet printer produces images on a receiver by ejecting ink droplets onto the receiver in an imagewise fashion. The advantages of non-impact, low-noise, low energy use, and low cost operation in addition to the capability of the printer to print on plain paper are largely responsible for the wide acceptance of ink jet printers in the marketplace.

However, it is often desirable to print images on differently sized paper supplies, such as 4 inch (10.16 cms) by 6 inch (15.24 cms) size paper or 8 inch (20.32 cms) by 10 inch (25.40 cms) sized paper. In the prior art, this is accomplished by using a relatively short length print head to print both paper sizes. In this case, multiple printing passes for either paper size are required because the image is printed in a plurality of adjacent "swaths". This is due to the relatively short length of the print head. In this case, productivity is reduced because the relatively short length "swaths" require multiple printing passes to print an image regardless of paper size. Typically, paper of a larger size is used whereon the image is printed and then the paper is cut to the desired size. In this case, paper is wasted and productivity is reduced particularly when the cutting operation is manual.

U.S. Pat. No. 5,312,196 titled "Portable Printer And Sheet Feeder" and issued May 17, 1994 in the name of Ng Lian Hock, et al. discloses an inkjet printer wherein the printer and sheet feeder are rotatable about a common axis into various operating modes, including one in which manual sheet feeding may be accomplished. Thus, this patent discloses orienting the sheet feeder in one direction to print in one operating mode and then reorienting (i.e., rotating) the sheet feeder in another direction to print in another printing mode. However, a problem apparently associated with the Ng Lian Hock, et al. device is that changing printing modes is time consuming and therefore cost-inefficient because the sheet feeder requires reorientation. That is, it would be preferable if changing printing modes were accomplished without sheet feeder reorientation.

Therefore, there has been a long-felt need to provide an inkjet printer, and method of assembling the printer, for printing an image on a first receiver of a first size and on a second receiver of a second size, wherein a print head belonging to the printer prints the image on the first receiver and on the second receiver without reorienting the receivers or changing-out the print head to a different size print head.

SUMMARY OF THE INVENTION

An object of the present invention is to provide an inkjet printer, and method of assembling the printer for printing an image on a first receiver of a first size and on a second receiver of a second size, wherein a print head belonging to the printer is prints the image on the first receiver and on the second receiver avoiding reorienting receivers or changing-out the print head to a different size print head.

With the above object in view, the invention resides in a printer for printing an image on a first receiver of a first size and on a second receiver of a second size larger than the first size, comprising a print head movable along a first direction for printing the image on the first receiver in one printing pass and movable to-and-fro in the first direction for printing the image on the second receiver in at least one printing swath, so that the image is printed on the first receiver or the second receiver while the print head moves only in the first direction; a first receiver supply associated with said print head for supplying the first receiver to said print head; and a second receiver supply associated with said print head for supplying the second receiver to said print head.

According to a preferred embodiment of the present invention, an inkjet printer is provided for printing an image on a first receiver having a first width or for printing the image on a second receiver having a second width greater than the first width. The first receiver is fed in a first direction and the second receiver is fed in a second direction orthogonal to the first direction. However, the print head prints the image on the first receiver while the print head moves only in the first direction or prints the image on the second receiver while the print head moves to-and-fro only in the first direction. Thus, the print head need not be reoriented or changed-out to print on either receiver.

According to this preferred embodiment of the invention, the printer includes an ink jet print head capable of ejecting a plurality of ink droplets for printing the image on the first receiver and on the second receiver. A first receiver supply is disposed near the print head for supplying the first receiver to the print head. Also, a first feeder mechanism is disposed near the first receiver supply for feeding the first receiver from the first receiver supply to the print head. A second receiver supply is disposed near the print head for supplying the second receiver to the print head. Also, a second feeder mechanism is disposed near the second receiver supply for feeding the second receiver from the second receiver supply to the print head. Moreover, an ink reservoir is connected to the print head for supplying ink to the print head. A pressure regulator is connected to the ink reservoir for regulating pressure in the ink reservoir to obtain a suitable flow of the ink from the ink reservoir to the print head. In addition, a controller is connected to the print head, the first feeder mechanism, the second feeder mechanism, the motor and the pressure regulator for controlling synchronous operation thereof. An image source is connected to the print head for supplying image data to the print head, so that the print head forms the image on the first receiver or on the second receiver. According to the invention, the print head controllably prints the image on the first receiver while the print head moves only in the first direction or prints the image on the second receiver while the print head moves to-and-fro only in the first direction. In this manner, the printer prints the image on a first receiver of a first size to be fed in a first direction and on a second receiver of a second size to be fed in a second direction without reorienting the receivers or changing-out the print head.

A feature of the preferred embodiment of the present invention is the provision of a print head that is movable only in a first direction for printing an image on a first receiver of a first size fed in the first direction or movable to-andfro only in the first direction to print the image on a second receiver of a second size fed in a second direction orthogonal to the first direction.

An advantage of the preferred embodiment of the present invention is that a single print head may be used to print images on a first sized receiver and on a second sized receiver without reorienting the receivers or changing-out the print head.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
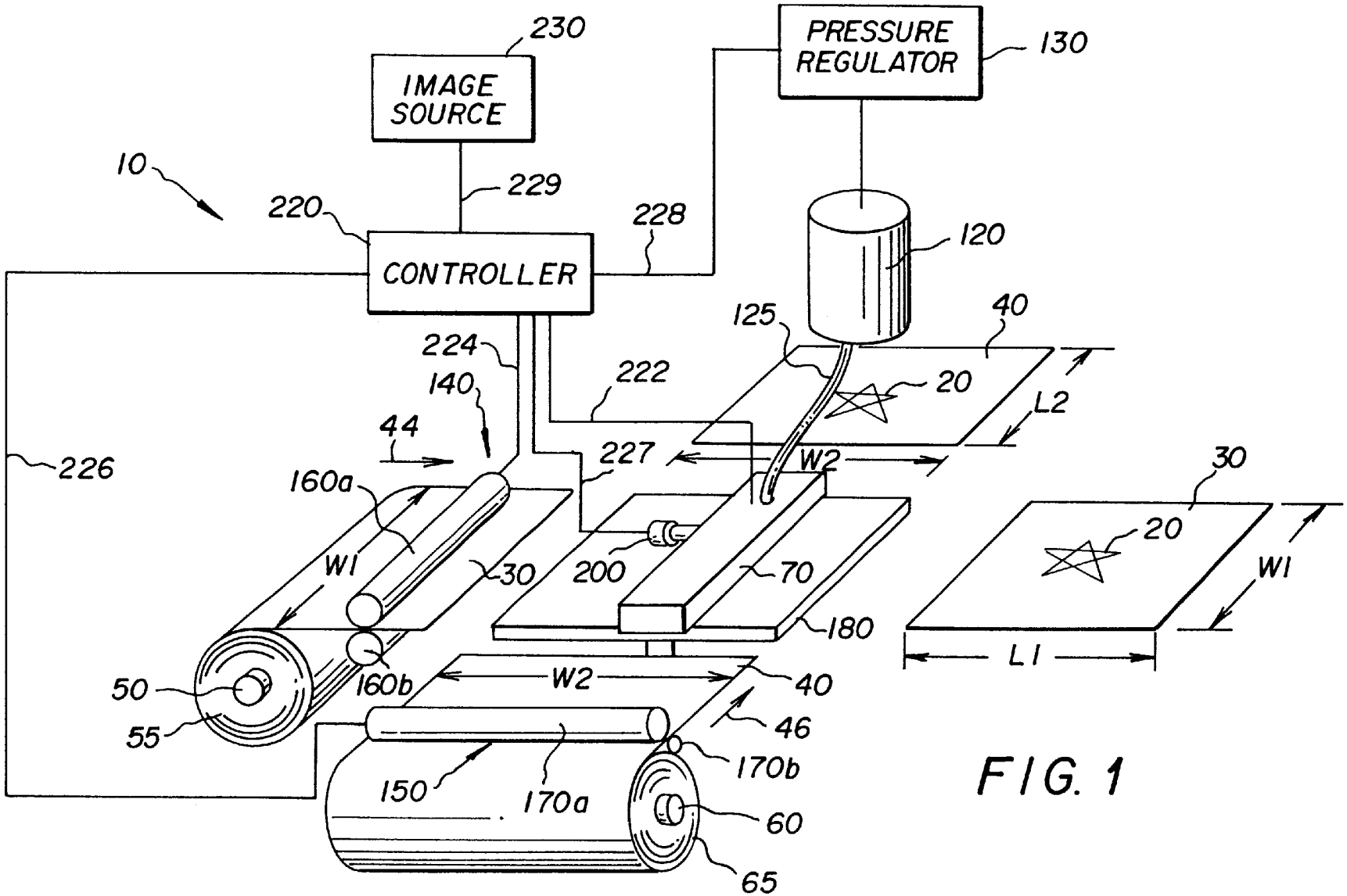
FIG. 1 is a view in perspective of a preferred first embodiment inkjet printer for printing an image on a first receiver fed from a first receiver supply and on a second receiver fed from a second receiver supply disposed orthogonal to the first receiver supply, the printer including an inkjet print head movable only in the first direction for printing on the first receiver and movable to-and-fro only in the first direction for printing on the second receiver, the first and second receiver supplies being in the form of continuous rolls.

Therefore, referring to FIG. 1, there is shown a first embodiment inkjet printer, generally referred to as 10, for printing an image 20 on a first receiver 30 having a first width "W1". Printer 10 is also capable of printing image 20 on a second receiver 40 having a second width "W2", wherein second width "W2" (e.g., 10 inches or 25.40 cms) is greater than first width "W1" (e.g., 6 inches or 15.24 cms). For reasons disclosed hereinbelow, first receiver 30 is to be fed in a first direction 44 and second receiver 40 is to be fed in a second direction 46 orthogonal to and in the same plane as first direction 44. Each of receivers 30/40 may be a reflective-type receiver (e.g., paper) or a transmissive-type receiver (e.g., transparency). Moreover, according to this first embodiment of the invention, first receiver 30 is a continuous roll of receiver wound about a first spool 50 to define a first receiver supply 55. Second receiver 40 is also a continuous roll of receiver wound about a second spool 60 to define a second receiver supply 65.

Figure 2:
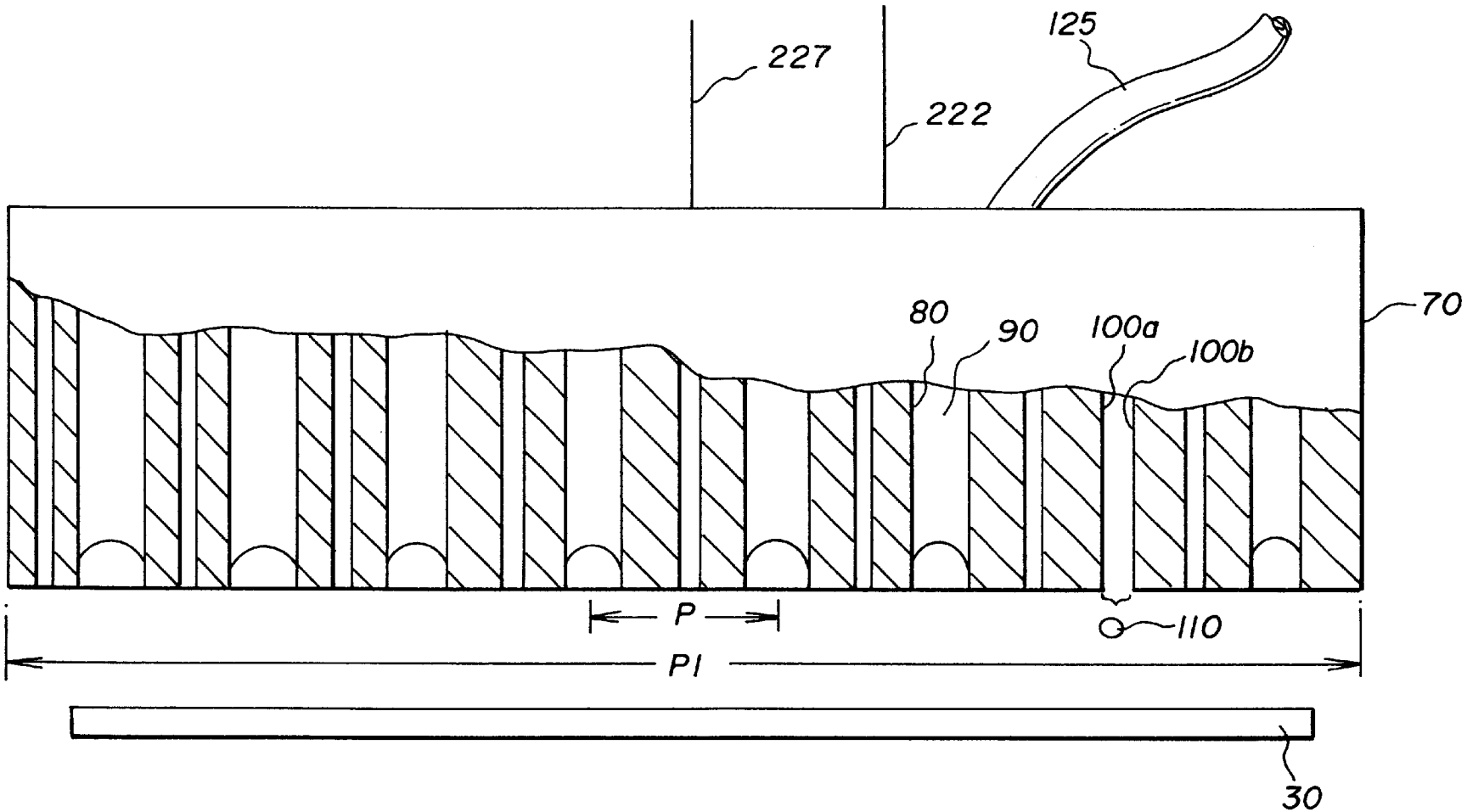
FIG. 2 is a view in partial elevation of the print head belonging to the present invention.
Figure 3:
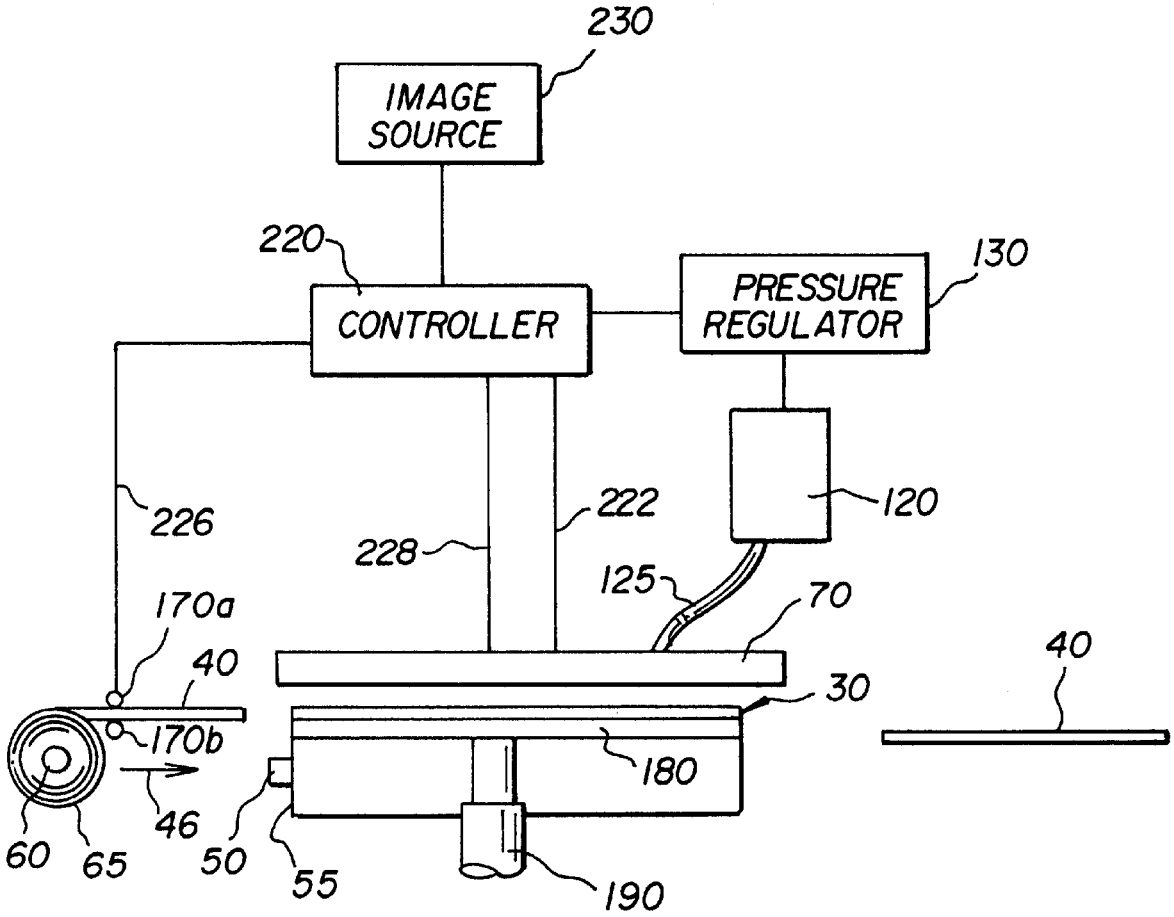
FIG. 3 is a view in elevation of the first embodiment of the present invention.

Referring to FIGS. 1, 2 and 3, printer 10 comprises a print head unit including an elongate print head 70 of length "P1" having a plurality of ink channels 80 formed therein spaced-apart by a constant pitch "P". For reasons disclosed hereinbelow, length of print head 70 may be equal to first width W1 or greater than first width W1. That is, for reasons of increased productivity, it is highly desirable that print head 70 be substantially wider than width W1 of receiver 30. In other words, second width W2 is greater than length of print head 70 and length of print head 70 is greater than first width W1. Thus, image 20 can be printed in one pass of print head 70. However, if desired for high image quality, multiple passes with print head dithering can be used; however, in this case "end effects" should be avoided.

Referring again to FIGS. 1, 2 and 3, each channel 80, which is adapted to hold an ink body 90, is defined by a pair of oppositely disposed parallel side walls 100*a* and 100*b*. Of course, in order to print image 20 on first receiver 30 and on second receiver 40, an ink droplet 110 must be released from ink channel 80 in the direction of first receiver 30 or second receiver 40, as the case may be, so that droplet 110 is intercepted by first receiver 30 or second receiver 40. To achieve this result, print head 70 may be a "piezoelectric" ink jet print head formed of a piezoelectric material, such as lead zirconium titanate (PZT). Such a piezoelectric material is mechanically responsive to electrical stimuli so that side walls 100*a*/*b* simultaneously inwardly deform when electrically stimulated. When side walls 100*a*/*b* simultaneously inwardly deform, volume of channel 90 decreases to squeeze ink droplet 110 from channel 90. Sidewalls 100*a*/*b* return to their quiescent initial positions when the electrical stimuli is removed. Of course, ink is supplied to channels 90 from an ink supply reservoir 120 connected to print head 70, such as by means of a suitable flexible conduit 125. Also, a pressure regulator 130 is connected to ink reservoir 120 for regulating pressure in ink reservoir 120. The purpose of regulating pressure in ink reservoir 120 is to obtain controlled flow of the ink from ink reservoir 120 to print head 70 and thus into channels 80.

It may be appreciated, however, that the type of "drop on demand" piezoelectric print head disclosed hereinabove, is but one of several types of print heads usable with the invention. The present invention is also usable with these other print head types, as well. For example, "drop on demand" piezoelectric print head 70 may instead be a "thermal" piezoelectric print head, wherein thermal energy is used to raise temperature of a ink meniscus poised at each nozzle in order to reduce surface of the meniscus. When surface tension is reduced to a predetermined value, an ink droplet is released from the nozzle. As another example, the invention is also usable with a "continuous" ink jet print head type rather than the piezoelectric print head type disclosed herein.

Still referring to FIGS. 1, 2 and 3, a first feeder mechanism, generally referred to as 140, is disposed near first receiver supply 55. First feeder mechanism 140 is capable of intimately engaging first receiver 30 for feeding first receiver 30 in first direction 44, so that first receiver 30 feeds from first receiver supply 55 to print head 70. Also, a second feeder mechanism, generally referred to as 150, is disposed near second receiver supply 65. Second feeder mechanism 150 is capable of intimately engaging second receiver 40 for feeding second receiver 40 in second direction 46, so that second receiver 40 feeds from second receiver supply 65 to print head 70. In this regard, first feeder mechanism 140 may comprise a pair of oppositely disposed, elongate, and motorized first rollers 160*a* and 160*b* for transporting first receiver 30 therebetween. Similarly, second feeder mechanism 150 may comprise a pair of oppositely disposed, elongate, and motorized second rollers 170*a* and 170*b* for transporting second receiver 40 therebetween. Moreover, also provided is a platen 180 aligned with the travel paths of both first receiver 30 and second receiver 40. The purpose of platen 180 is to support first receiver 30 or second receiver 40 thereon while image 20 is printed. According to this first embodiment of the invention, platen 180 may be supported by a support 190.

Figure 4:
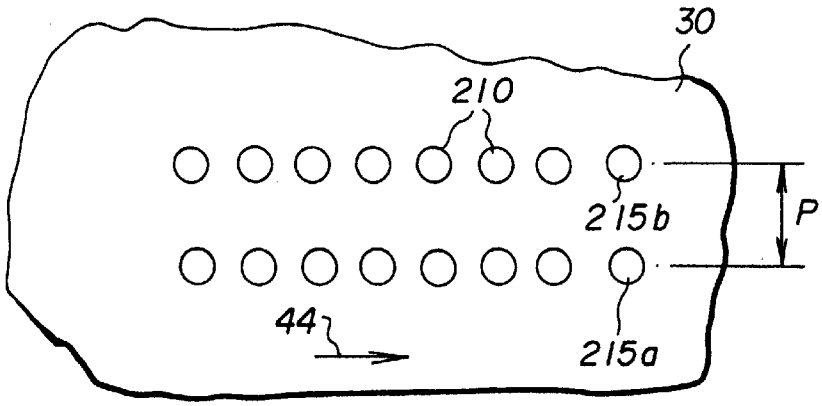
FIG. 4 is a enlarged fragmentation view in plan of the first receiver showing a multiplicity of ink marks thereon (only some of which are shown), the marks having been printed as the print head moved in the first direction.

As best seen in FIGS. 1 and 4, print head 70 is capable of printing image 20 on first receiver 30 in a single printing pass as print head 70 moves in first direction 44. This is so because length P1 of print head 70 is preferably greater than first width W1 of first receiver 30. However, length of print head 70 may be equal than first width W1, if desired. A motor 200 is connected to print head 70 for moving print head 70 across platen 180 in first direction 44. Note it would also be possible to hold print head 70 fixed and move receiver 30 to effect printing over an area W1 by L1. In this regard, as print head 70 makes a printing pass across platen 180 in first direction 44, ink channels 80 are selectively enabled so that print head 70 will print a multiplicity of ink marks 210 (only some of which are shown) spaced-apart by constant pitch P in order to form image 20. In this regard, marks 210 are formed as print head 70 moves in first direction 44 and are shown for purposes of illustration as arranged in two parallel rows 215*a* and 215*b*. Only two rows 215*a*/*b* of marks are shown for purposes of illustration, it being understood that the typical image 20 will contain a multiplicity of such rows of marks 210. When a desired length "L1" (e.g., 8 inches or 20.32 cms) of receiver 30 has been printed upon, receiver 30 of length L1 is cut by a first cutter (not shown) to obtain a finished print of size W1 by L1.

Figure 5:
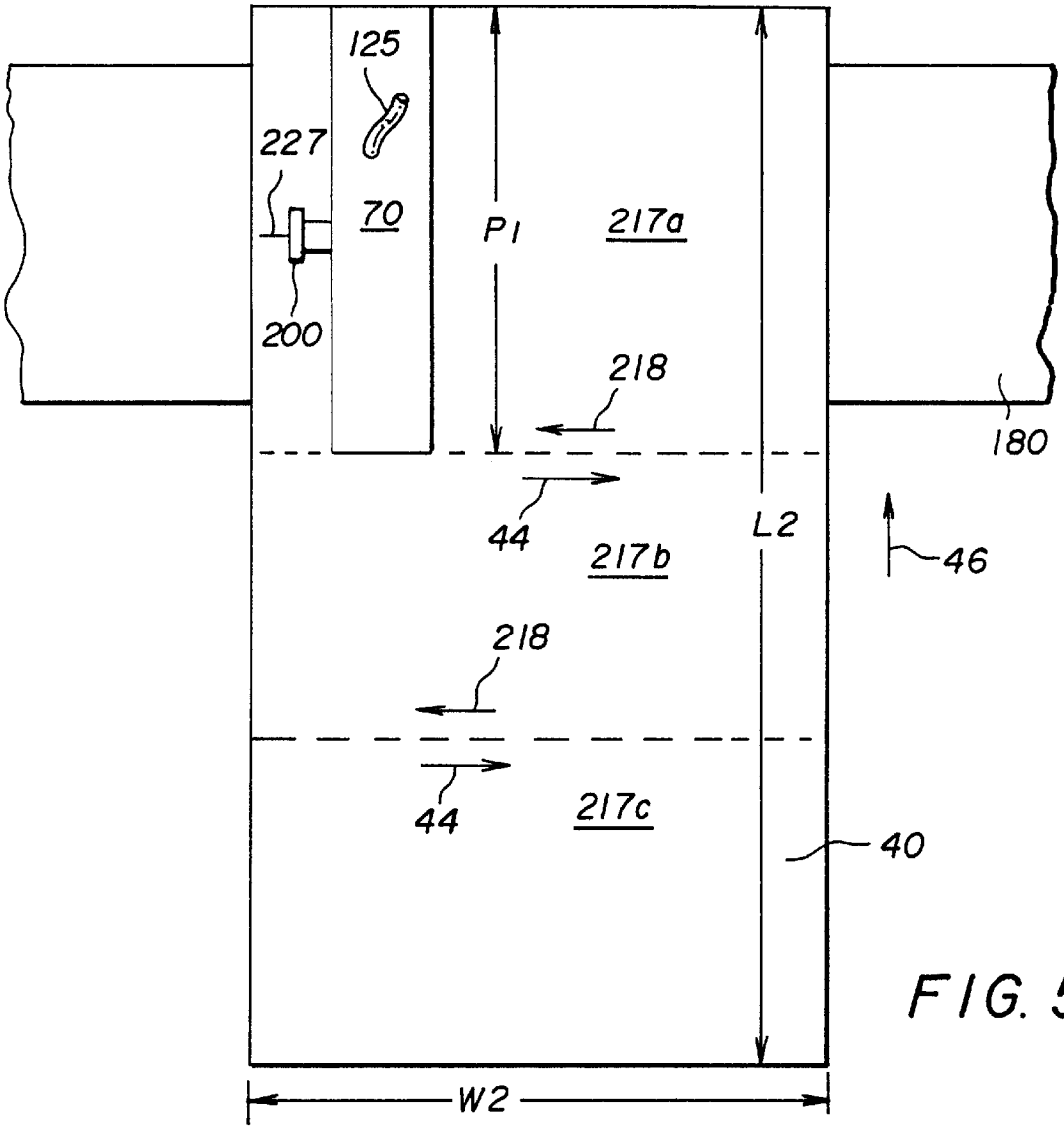
FIG. 5 is a view in plan of the second receiver as the print head reciprocates to-and-fro across the second receiver, alternating between the first direction and a third direction which is opposite the first direction.

Referring to FIGS. 1 and 5, the manner of printing image 20 on receiver 40 will now be described. In this regard, previously mentioned motor 200 will move print head 70 in first direction 44 to print a first "swath" 217*a* having dimensions W2 by P1. Second receiver 40 is then incremented distance of up to P1 in the second direction 46. Motor 200 will then reverse direction of print head 70 to move print head 70 in a third direction 218 opposite first direction 44 in order to print a second swath 217*b* also having dimensions W2 by P1, this is referred to as "bidirectional" printing. Alternatively, motor 200 will reverse direction in order to return print head 70 to its starting position, without printing a second swath, for "monodirectional" printing. After second swath 217*b* is printed, second receiver 40 is again incremented distance up to P1 and motor 200 again reverses direction of print head 70 to move print head 70 in first direction 44 in order to print a third swath 217*c* having dimensions W2 by P1. In this manner, print head 70 reciprocates to-and-fro across second receiver 40 as second receiver 40 moves in second direction 46. When a desired length L2 (e.g., 10 inches or 25.40 cms) of receiver 40 has been printed upon, receiver 40 of width W2 is cut by a second cutter (not shown) to obtain a finished print of size W2 by L2.

As best seen in FIG. 1, a controller 220 is connected to print head 70 by a first wire 222, to first feeder mechanism 140 by a second wire 224, to second feeder mechanism 150 by a third wire 226, to motor 200 by a fourth wire 227, and to pressure regulator 130 by a fifth wire 228, for controlling synchronous operation of these components. In this regard, controller 220 may be a model "COMPUMOTOR" controller available from Parker Hannifin, Incorporated located in Rohrnert Park, Calif. Moreover, an image source 230 is connected to controller 220, and thus to print head 70, such as by a sixth wire 229. The purpose of image source 230 is to supply image data to print head 70 so that print head 70 is capable of forming image 20 on first receiver 30 and second receiver 40. In this regard, image source 230 may be a personal computer, scanner, camera, or other similar image input device.

Referring to FIGS. 1 and 5, it may be appreciated that the preferred first embodiment of printer 10 is configured to print image 20 on either first receiver 20 or second receiver 40 without reorienting either of first receiver supply 55 or second receiver supply 65 and without changing-out print head 70 to a different size print head. In other words, print head 70 prints entire image 20 on first receiver 30 while print head 70 moves only in first direction 44. This aspect of the invention advantageously allows print head 70 to perform "full-width" printing on receiver 30, which has relatively narrow first width W1. Thus, while print head 70 prints on first receiver 30, print head 70 "fast scans" across first receiver 30 moving along first length "L1" of first receiver 30.

Again referring to FIGS. 1 and 5, it may be appreciated that print head 70 prints image 20 on second receiver 40 by performing printing using substantially the same motion as used for printing image 20 on first receiver 30. In other words, print head 70 prints image 20 on second receiver 40 while print head 70 reciprocates to-and-fro only in first direction 44 and second direction 218. Thus, second receiver 65 need not be rotated to print on second receiver 40. That is, print head 70 prints in two orthogonal directions without reorienting first receiver supply 55 or second receiver supply 65 and without changing-out print head 70 to a print head of a different size. As disclosed more fully hereinafter, this aspect of the invention advantageously allows print head 70 to efficiently perform printing on receiver 40 having relatively wider second width W2. Moreover, while print head 70 prints on second receiver 40, print head 70 fast scans across second receiver 40 moving along second width W2 of second receiver 40 as second receiver 40 rests on platen 180.

Still referring to FIGS. 1 and 5, it may be understood from the description hereinabove that substantially the same movement of print head 70 is used for printing images 20 on receivers moving orthogonally with respect to each other. That is, as first receiver 30 moves in a first direction, print head 70 is used to cover the full width (i.e., W1) of first receiver 30 to obtain relatively high printing productivity by avoiding need for "swath" printing. Also, when moving in a second direction orthogonal to the first direction, print head 70 scans across second receiver 40 for producing prints of any desired length L2 limited only by the total length of second receiver 65. After each image 20 is produced, first cutter (not shown) or second cutter (also not shown) cuts either first receiver 30 or second receiver 40, as the case may be, to provide a print of desired size.

Figure 6:
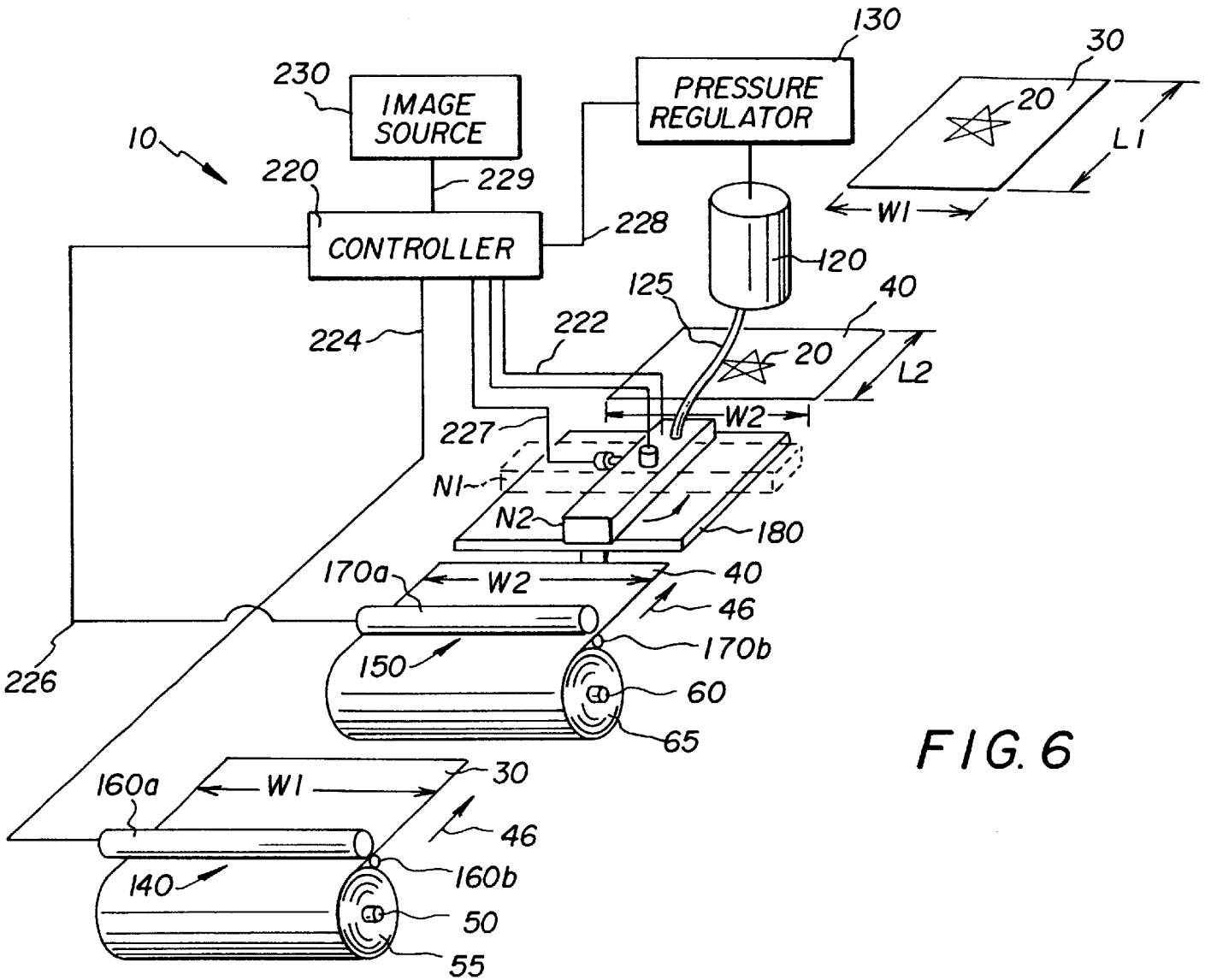
FIG. 6 is a view in perspective of a second embodiment of the present invention wherein the print head is rotatable.

Referring to FIG. 6, a second embodiment of the present invention is there shown for printing image 20 on first receiver 30 and second receiver 40. According to this second embodiment of the invention, print head 70 is rotatable from a first orientation "N1" to a second orientation "N2", the second orientation N2 being orthogonal to the first orientation N1. Also, according to the second embodiment of the invention, first receiver supply 55 is arranged in tandem with second receiver supply 65, so that first receiver 30 and second receiver 40 both feed in second direction 46. While in first orientation N1, print head 70 prints image 20 on first receiver 30 as previously described for the first embodiment of the present invention. However, while in the second orientation N1, certain ones of channels 80 at both ends of print head 70 are deselected for activation (i.e., disabled) such that ink is deposited only on first receiver 30. The printing technique of this second embodiment of the invention advantageously allows receivers 30 and 40 to be fed in a single direction, rather than orthogonal directions. This may be desirable for in-line production techniques, where it is necessary that printing and assembly of printed materials be performed along a generally straight production line.

Figure 7:
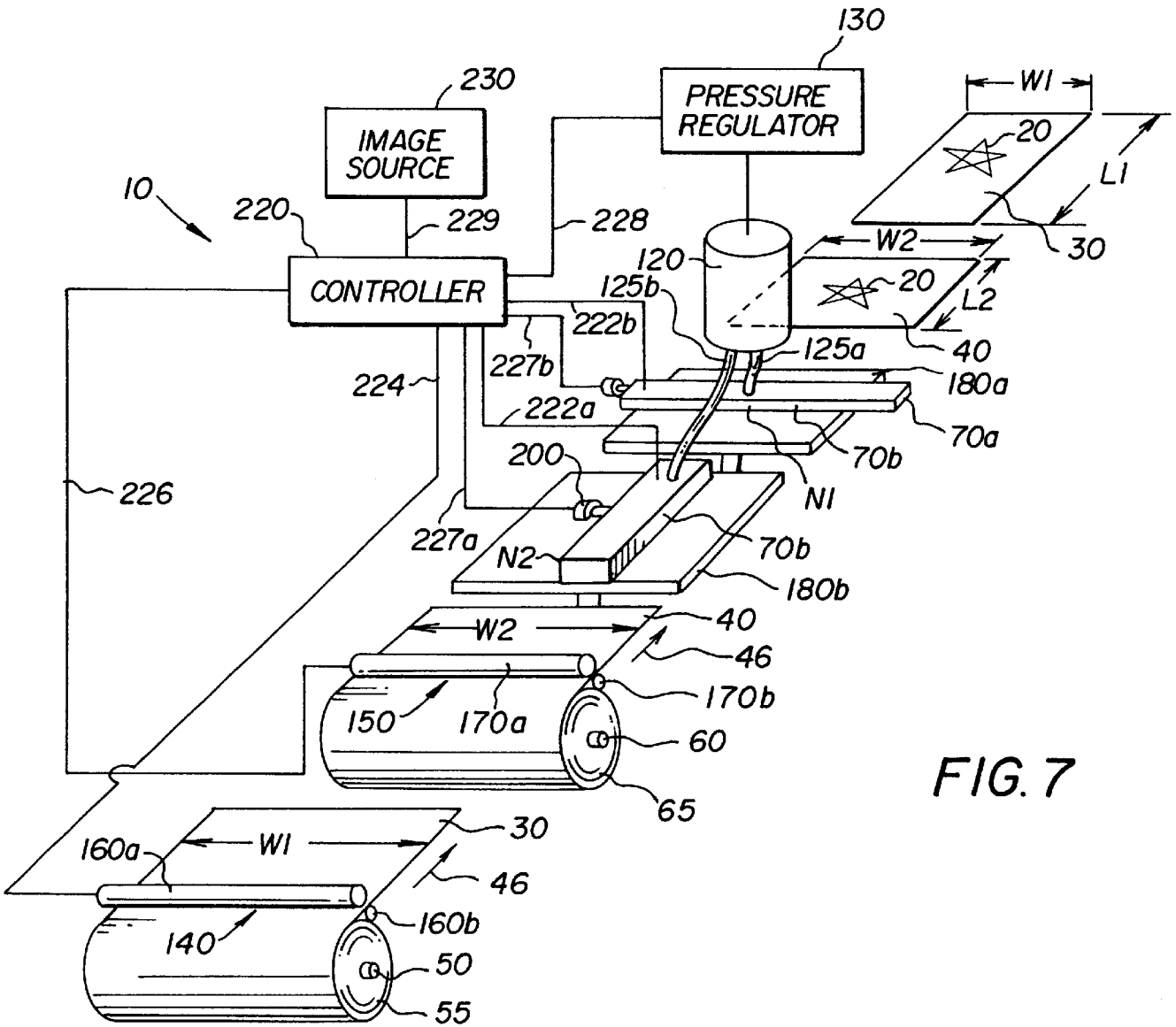
FIG. 7 is a view in perspective of a third embodiment of the present invention, comprising two print heads disposed orthogonally with respect to each other.

Referring to FIG. 7, there is shown a third embodiment of the present invention for printing image 20 on first receiver 30 and second receiver 40. This third embodiment of the invention is substantially similar to the second embodiment of the invention, except that a first print head 70*a*, having the previously mentioned first orientation N1, and a second print head 70*b*, having the previously mentioned second orientation N2, are provided. Also provided are a first platen 180*a* and a second platen 180*b* associated with their respective first print head 70*a* and second print head 70*b*. In addition, connecting reservoir 120 with print heads 70*a* and 70*b* are conduits 125*a* and 125*b* for supplying ink to print heads 70*a* and 70*b*, respectively.

As shown in FIG. 7, first print head 70*a* will print image 20 on first receiver 30 in substantially the same manner as the print head 70 belonging to the first embodiment of the invention. Also, second print head 70*b* will print image 20 on second receiver 40 in substantially the same manner as the print head 70 belonging to the first embodiment of the invention. An advantage of this third embodiment of the invention is that if one print head (i.e., either print head 70*a* or print head 70*b*) malfunctions and is taken out of service, the other print head may be used to print on receivers 30/40 by suitably operating controller 220.

Figure 8:
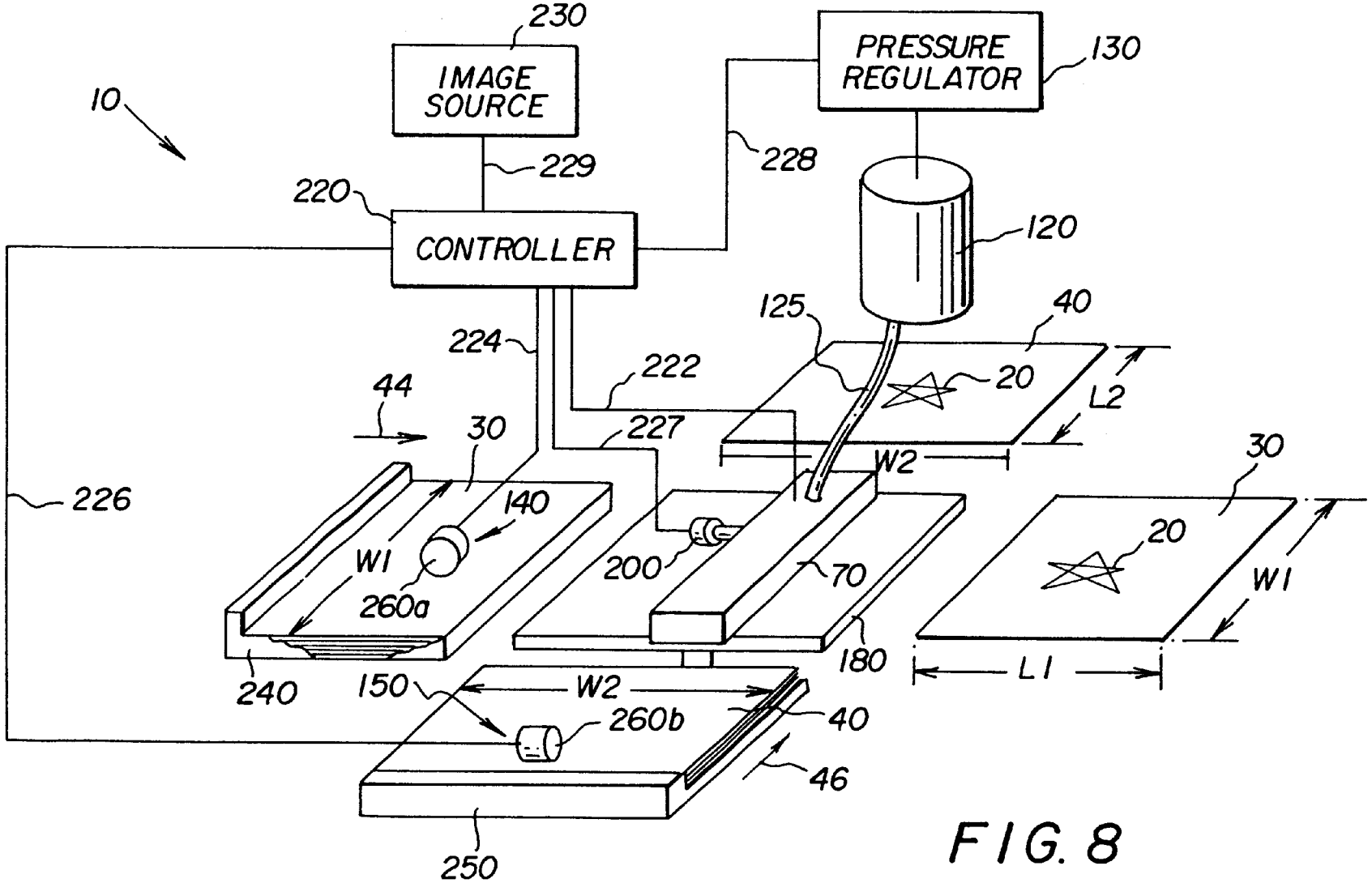
FIG. 8 is a view in perspective of a fourth embodiment of the present invention wherein the first and second receiver supplies are first and second receiver supply trays holding supplies of cuts sheets of receiver.

Referring to FIG. 8, there is shown a fourth embodiment of the present invention for printing image 20 on first receiver 30 and second receiver 40. This fourth embodiment of the invention is similar to the first embodiment of the invention, except that first receiver supply 55 and second receiver supply 65, which in the first embodiment are continuous rolls of receiver, are replaced by a first receiver supply tray 240 and a second receiver supply tray 250, respectively. First tray 240 holds a supply of cuts sheets of first receiver 30 therein and second tray 250 holds a supply of cut sheets of second receiver 40 therein. Also, first rollers 160*a*/*b* of the first embodiment are replaced by a motorized first picker feed roller 260*a* capable of intimately engaging individual sheets of first receiver 30 in order to feed the sheets to print head 70. Moreover, second rollers 170*a*/*b* of the first embodiment are replaced by a motorized second picker feed roller 260*b* capable of intimately engaging individual sheets of second receiver 40 in order to feed the sheets to print head 70. Each of picker feed rollers 260*a*/*b* are connected to controller 220, such as by means of previously mentioned second wire 224 and third wire 226, respectively, for controlling operation of feed rollers 260*a*/*b*. An advantage of this fourth embodiment of the invention is that cut sheets of receiver, rather than continuous rolls of receiver, may be printed by printer 10, if desired.

It may be appreciated from the description hereinabove, that an advantage of the preferred embodiment (see FIG. 1) of the present invention is that a single print head is used to print images on a first sized receiver and on a second sized receiver without reorienting the receivers or changing-out the print head to a different sized print head. The receivers need not be reoriented because substantially the same movement of the print head is used to print the image on either receiver. The print head need not be changed-out because only a single print head is needed.

Another advantage of the present invention is that high printing productivity is obtained. High printing productivity results when P1>W1 without losing the format flexibility that results when P1<W2. This is preferable to having two print heads, where P1>W1 and P2<W2, P1 and P2 being oriented perpendicular to each other.

While the invention has been described with particular reference to various embodiments thereof, it will be understood by those skilled in the art that various changes may be made and equivalents may be substituted for elements of the preferred embodiments without departing from the invention. For example, although the present invention has been disclosed with reference to use with an inkjet printer, the invention may also be used with other types of printers, such a thermal dye printers and laser printers or whenever it is desirable to print images on different sized receivers without reorienting the receivers or changing-out the print head to a different size print head.

Therefore, what is provided is an inkjet printer and method of assembling the printer for printing an image on a first receiver of a first size and on a second receiver of a second size without reorienting the receivers or changing-out the print head to a different size print head.

PARTS LIST

L1 . . . cut length of finished print for first receiver
L2 . . . cut length of finished print for second receiver
N1 . . . first orientation of print head
N2 . . . second orientation of print head
P . . . pitch of ink channels
P1 . . . length of print head
W1 . . . width of first receiver and length of print head
W2 . . . width of second receiver
X . . . second incremental distance print head is indexed
10 . . . printer
20 . . . image
30 . . . first receiver
40 . . . second receiver
44 . . . first direction
46 . . . second direction
50 . . . first spool
55 . . . first receiver supply
60 . . . second spool
65 . . . second receiver supply
70 . . . print head
70*a* . . . first print head
70*b* . . . second print head
80 . . . ink channels
90 . . . ink body
100*a*/*b* . . . side walls
110 . . . ink droplet
120 . . . ink supply reservoir
125 . . . conduit
130 . . . pressure regulator

140 . . . first feeder mechanism
150 . . . second feeder mechanism
160*a*/*b* . . . first rollers
170*a*/*b* . . . second rollers
180 . . . platen
180*a* . . . first platen
180*b* . . . second platen
190 . . . support
200 . . . motor
210 . . . ink marks
215*a* . . . first row of ink marks
215*b* . . . second row of ink marks
218 . . . third direction
220 . . . controller
222 . . . first wire
224 . . . second wire
226 . . . third wire
227 . . . fourth wire
228 . . . fifth wire
229 . . . sixth wire
230 . . . image source
240 . . . first receiver supply tray
250 . . . second receiver supply tray
260*a* . . . first picker feed roller
260*b* . . . second picker feed roller

What is claimed is:

1. A printer for printing a first image on a first receiver of a first size and a second image on a second receiver, the second receiver being of a second size larger than the first size, comprising:

(a) a print head that is movable along a first direction, the print head being operational in a first printing mode for printing the first image on the first receiver in one printing pass while the first receiver is supported on a platen and the first receiver moves relative to the print head in the first direction and the print head being operational in a second printing mode for printing the second image wherein the print head is movable to-and-fro in the first direction for printing the second image on the second receiver in at least one printing swath while the second receiver is supported on the platen, so that the first image is printed on the first receiver and the second image is printed on the second receiver while the first receiver and the second receiver are supported on the same area of the platen above which area printing occurs;

(b) a first receiver supply associated with said print head for supplying the first receiver to said platen, the first receiver being supplied to said platen in said first printing mode so as to move in the first direction; and (c) a second receiver supply associated with said print head for supplying the second receiver to said platen, the second receiver being supplied to said platen in said second printing mode so as to move in a second direction orthogonal to the first direction.

2. The printer of claim 1, (a) wherein said first receiver supply is a continuous roll of receiver; and (b) wherein said second receiver supply is a continuous roll of receiver.

3. The printer of claim 1, (a) wherein said first receiver supply is a first receiver supply tray; and (b) wherein said second receiver supply is a second receiver supply tray.

4. The printer of claim 1, (a) wherein said first receiver supply is a first receiver supply tray having a supply of cut sheets of the first receiver therein; and (b) wherein said second receiver supply is a second receiver supply tray having a supply of cut sheets of the second receiver therein.

5. The printer of claim 1, further comprising an ink reservoir coupled to said print head for supplying ink to said print head.

6. The printer of claim 5, further comprising a pressure regulator coupled to said ink reservoir for regulating pressure in said ink reservoir.

7. The printer of claim 1, further comprising an image source coupled to said print head for supplying image data to said print head, so that said print head forms the first image on the first receiver and the second image on the second receiver.

8. A printer for printing a first image on a first receiver of a first size and for printing a second image on a second receiver of a second size larger than the first size, comprising:

(a) a first elongated print head for printing the first image on the first receiver while the first receiver moves relative to the first print head in a first direction, the first print head having an orientation wherein a series of recording elements are arranged in a second direction which coincides with the direction of elongation of the first print head, the second direction being orthogonal to the first direction; and (b) a second print head movable to-and-fro along the second direction for printing, during movement of the second print head in the second direction, the second image on the second receiver;

(c) a first receiver supply associated with said first print head for supplying the first receiver to said first print head by moving the first receiver in the first direction; and (d) a second receiver supply associated with said second print head for supplying the second receiver to said second print head by moving the second receiver in the first direction.

9. A printer for printing a first image on a first receiver of a first size to be fed in a first direction and for printing a second image on a second receiver of a second size larger than the first size, the second receiver to be fed in a second direction orthogonal to the first direction, comprising:

(a) a first print head for printing the first image on the first receiver as the first receiver moves relative to the first print head in the first direction;

(b) a second print head movable to-and-fro along the first direction for printing the second image on the second receiver in at least one printing swath;

(c) a first receiver supply for supplying the first receiver to said first print head;

(d) a first feeder mechanism disposed near said first receiver supply, said first feeder mechanism capable of engaging the first receiver for feeding the first receiver in the first direction from said first receiver supply to said first print head;

(e) a second receiver supply for supplying the second receiver to said second print head; and (f) a second feeder mechanism disposed near said second receiver supply, said second feeder mechanism capable of engaging the second receiver for feeding the second receiver in the second direction from said second receiver supply to said second print head.

10. A printer for printing a first image on a first receiver having a first width and a second image on a second receiver having a second width wider than the first width, the first receiver to be fed in a first direction and the second receiver to be fed in a second direction orthogonal to the first direction, the printer comprising:

(a) a first print head for printing the first image on the first receiver as the first receiver moves relative to the first print head in the first direction;

(b) a second print head movable to-and-fro in the first direction for printing the second image on the second receiver;

(c) a first receiver supply for supplying the first receiver to said first print head;

(d) a first feed roller disposed near said first receiver supply, said first feed roller adapted to intimately engage the first receiver for feeding the first receiver in the first direction from said first receiver supply to said first print head;

(e) a second receiver supply for supplying the second receiver to said second print head;

(f) a second feed roller disposed near said second receiver supply and adapted to intimately engage the second receiver for feeding the second receiver in the second direction from said second receiver supply to said second print head;

(g) a first motor for moving said first print head relative to the first receiver;

(h) a second motor connected to said second print head for moving said second print head relative to the second receiver;

(i) an ink reservoir connected to said first print head and said second print head for supplying ink to said first print head and said second print head;

(j) a pressure regulator connected to said ink reservoir for regulating pressure in said ink reservoir to obtain a flow of the ink from said ink reservoir to said first print head and said second print head;

(k) a controller connected to said first print head, said second print head, said first feed roller, said second feed roller, said first motor, said second motor, and said pressure regulator for controlling synchronous operation thereof; and (l) an image source connected to said first print head and said second print head for supplying image data to said first print head and said second print head, so that said first print head and said second print head are capable respectively of forming the first image on the first receiver and the second image on the second receiver.

11. A method of operating a printer capable of printing a first image on a first receiver of a first size and a second image on a second receiver, the second receiver being of a second size larger than the first size, comprising the steps of:

(a) providing a print head movable along a first direction, printing the first image on the first receiver in one printing pass during a first printing mode while the first receiver is supported on a platen and the first receiver moves relative to the print head in the first direction and printing the second image on the second receiver during a second printing mode while moving the print head to-and-fro in the first direction and printing the second image on the second receiver in at least one printing swath while the second receiver is supported on the platen, so that the first image is printed on the first receiver and the second image is printed on the second receiver with the first receiver and the second receiver being supported on the same area of the platen above which printing occurs in both printing modes;

(b) providing a first receiver supply associated with the print head and supplying the first receiver to the platen in the first printing mode by moving the first receiver in the first direction; and (c) providing a second receiver supply associated with the print head and supplying the second receiver to the platen in the second printing mode by moving the second receiver to the platen in the second direction which is orthogonal to the first direction.

12. The method of claim 11, (a) wherein the step of providing a first receiver supply comprises the step of providing a first receiver supply that is a continuous roll of receiver; and (b) wherein the step of providing a second receiver supply comprises the step of providing a second receiver supply that is a continuous roll of receiver.

13. The method of claim 11, (a) wherein the step of providing a first receiver supply comprises the step of providing a first receiver supply that is a first receiver supply tray; and (b) wherein the step of providing a second receiver supply comprises the step of providing a second receiver supply that is a second receiver supply tray.

14. The method of claim 11, (a) wherein the step of providing a first receiver supply comprises the step of disposing a first receiver supply that is a first receiver supply tray having a supply of cut sheets of the first receiver therein; and (b) wherein the step of providing a second receiver supply comprises the step of disposing a second receiver supply that is a second receiver supply tray having a supply of cut sheets of the second receiver therein.

15. The method of claim 11, further comprising the step of coupling an ink reservoir to the print head for supplying ink to the print head.

16. The method of claim 15, further comprising the step of coupling a pressure regulator to the ink reservoir for regulating pressure in the ink reservoir.

17. The method of claim 11, further comprising the step of coupling an image source to the print head for supplying image data to the print head, so that the print head forms the image on the receiver.

18. A method of operating a printer capable of printing a first image on a first receiver of a first size and a second image on a second receiver of a second size larger than the first size, comprising the steps of:

(a) providing a first elongated print head and printing the first image while moving the first receiver sheet relative to the first print head in a first direction, the first print head having an orientation wherein a series of recording elements are arranged in a second direction which coincides with the direction of elongation of the first print head, the second direction being orthogonal to the first direction; and (b) providing a second print head movable to-and-fro in the second direction and printing the second image on the second receiver while moving the second print head to-and-fro along the second direction and with movement of the second receiver in the first direction;

(c) providing a first receiver supply associated with the first print head for supplying the first receiver to the first print head; and (d) providing a second receiver supply associated with the second print head for supplying the second receiver to the second print head.

19. A method of operating a printer to print a first image on a first receiver of a first size to be fed in a first direction and a second image on a second receiver, the second receiver being of a second size larger than the first size, the second receiver to be fed in a second direction orthogonal to the first direction, comprising the steps of:

(a) providing a first print head and printing the image on the first receiver as the first receiver moves relative to the first print head in the first direction;

(b) providing a second print head movable to-and-fro in the first direction and printing the image on the second receiver while the second print head moves to-and-fro in the first direction and with the second receiver moving in the second direction;

(c) providing a first receiver supply and supplying the first receiver to the first print head;

(d) providing a first feeder mechanism near the first receiver supply, the first feeder mechanism engaging the first receiver and feeding the first receiver in the first direction from the first receiver supply to the first print head;

(e) providing a second receiver supply and supplying the second receiver to the second print head; and (f) providing a second feeder mechanism near the second receiver supply, the second feeder mechanism engaging the second receiver and feeding the second receiver in the second direction from the second receiver supply to the second print head.

20. A method of assembling a printer capable of printing a first image on a first receiver having a first width and a second image on a second receiver having a second width wider than the first width, the first receiver to be fed in a first direction and the second receiver to be fed in a second direction orthogonal to the first direction, the method comprising the steps of:

(a) providing a first print head capable of moving along the second direction for printing the image on the first receiver;

(b) providing a second print head movable to-and-fro in the first direction for printing the image on the second receiver in at least one printing swath;

(c) disposing a first receiver supply near the first print head for supplying the first receiver to the first print head;

(d) disposing a first feed roller near the first receiver supply, the first feed roller adapted to intimately engage the first receiver for feeding the first receiver in the first direction from the first receiver supply to the first print head;

(e) disposing a second receiver supply near the second print head for supplying the second receiver to the second print head;

(f) disposing a second feed roller near the second receiver supply and adapted to intimately engage the second receiver for feeding the second receiver in the second direction from the second receiver supply to the second print head;

(g) connecting a first motor to the first print head for moving the first print head relative to the first receiver;

(h) connecting a second motor to the second print head for moving the second print head relative to the second receiver;

(i) connecting an ink reservoir to the first print head and the second print head for supplying ink to the first print head and the second print head;

(j) connecting a pressure regulator to the ink reservoir for regulating pressure in the ink reservoir to obtain a flow of the ink from the ink reservoir to the first print head and the second print head;

(k) connecting a controller to the first print head, the second print head, the first feed roller, the second feed roller, the first motor, the second motor, and the pressure regulator for controlling synchronous operation thereof; and (l) connecting an image source to the first print head and the second print head for supplying image data to the first print head and the second print head, so that the first print head and the second print head are capable of forming respectively the first image on the first receiver and the second image on the second receiver.

* * * * *